US005570929A

United States Patent [19]

Glockl

[11] Patent Number: 5,570,929

[45] Date of Patent: Nov. 5, 1996

[54] ACTIVE DYNAMIC SEAT

[76] Inventor: Josef Glöckl, Ammerseestrasse 6, D-8011 Kirchheim, Germany

[21] Appl. No.: 150,108

[22] PCT Filed: Mar. 29, 1993

[86] PCT No.: PCT/EP93/00757

§ 371 Date: Feb. 10, 1994

§ 102(e) Date: Feb. 10, 1994

[87] PCT Pub. No.: WO93/19645

PCT Pub. Date: Oct. 14, 1993

[30] Foreign Application Priority Data

Mar. 27, 1992 [DE] Germany ..... 42 10 135.2

[51] Int. Cl.[6] ..... A47C 1/02

[52] U.S. Cl. ..... 297/313; 297/339

[58] Field of Search ..... 297/314, 313, 297/337–339, 273, 463.2, DIG. 11, DIG. 1, 452.57, 452.27; 472/105, 135

[56] References Cited

U.S. PATENT DOCUMENTS

| | | | |
|---|---|---|---|
| 811,881 | 2/1906 | Steinbach | 297/313 |
| 1,094,293 | 4/1914 | Banks | 297/314 X |
| 2,048,148 | 7/1936 | Stoll . | |
| 2,373,694 | 4/1945 | Lentz | 297/314 X |
| 2,568,832 | 9/1951 | Stone | 297/314 X |
| 2,707,986 | 5/1955 | Johnson | 297/314 X |
| 2,799,323 | 7/1957 | Berg | 297/314 X |
| 3,103,356 | 9/1963 | Heines | 297/313 X |
| 3,323,152 | 6/1967 | Lerman | 297/452.57 X |
| 3,501,197 | 3/1970 | Burton | 297/452.57 X |
| 3,534,129 | 10/1970 | Bartel | 297/452.27 X |
| 4,099,697 | 7/1978 | Von Schuckmann | 297/314 X |
| 4,830,345 | 5/1989 | Mar | 297/314 X |

FOREIGN PATENT DOCUMENTS

| | | |
|---|---|---|
| 2460649 | 1/1981 | France . |
| 7311140 | 7/1973 | Germany . |
| 7531129 | 3/1976 | Germany . |
| 2642112 | 3/1978 | Germany . |

OTHER PUBLICATIONS 7,311,140 dtd Jul. 12, 1973 (Hesse) German Language Abstract (Utility Model).

*Primary Examiner*—Milton Nelson, Jr.
*Attorney, Agent, or Firm*—Birch, Stewart, Kolasch & Birch, LLP.

[57] ABSTRACT

An active dynamic seat has a base, a stiff intermediate piece linked to the base and a seating part linked to the intermediate piece. The seating part is rigidly secured to the intermediate piece and the intermediate piece is mounted in such a way on the base that its central area can tilt in all directions and slide vertically. In addition, one or several restoring devices are arranged on the intermediate piece, in the area below the mounting point on the base, for restoring the tilting movement and at the same time the vertical displacement of the intermediate piece and the seating part.

17 Claims, 4 Drawing Sheets

ACTIVE DYNAMIC SEAT

The invention relates to an active dynamic seat.

BACKGROUND OF THE INVENTION

Conventional seating furniture is designed in most cases so that the body, especially the back, is supported by correspondingly fashioned seating surfaces and backs in an anatomically maximally favorable position. Although such seating furniture is frequently felt to be comfortable, there is the decisive drawback that the body sits merely passively on such seats, i.e. the back muscles are hardly stressed, and the intervertebral disks are stressed merely statically in the "pressure mode". As a result, a long-term usage of such seat furnishings leads to degeneration of the back muscles and wasting of the intervertebral disks. Impairment of health and pains in the back and hip regions (e.g. sciatica) are the frequent consequence of such static and passive sitting.

For this reason, seating furnishings have been developed permitting a so-called active dynamic sitting wherein the back musculature and the intervertebral disks are constantly slightly active. This active dynamic sitting attitude is attained in practically all cases by maintaining the actual seat of the seating furniture in a labile position and making it optionally additionally resilient in the vertical direction.

Such an active dynamic seating device has been described, for example, in DE 73 11 140. This seat consists essentially of a seat part connected via a first tilting joint with a supporting shank, the latter, in turn, being articulated by means of a second tilting joint to the base of the seating device. In this arrangement, each tilting joint consists preferably of a cap formed respectively at the end of the supporting shank, this cap being guided in a hollow cylinder and stressed by a coil spring arranged in the hollow cylinder.

On account of the planar structure of the underside of the cap, the latter is in contact, in the non-stressed condition, with the bottom or, respectively, top of the hollow cylinder so that, without stress, a perfect alignment is achieved of base, supporting shank, and seat. When stress is exerted on this seating device, the two coil springs of the tilting joints are compressed, the two caps being urged into the two hollow cylinders. The tilting movement of these two joints is attained by the feature that the bore in the top of the lower cylinder or, respectively, in the bottom of the upper hollow cylinder is slightly larger than the outer diameter of the supporting shank.

However, the disadvantage arises herein that the maximally possible tilting angle of each tilting joint in the stressed condition is dependent on the distance of the planar side of the cap from the bottom or top of the hollow cylinder and thus on the weight of the person presently using this seating device. Moreover, it is extremely difficult to maintain one's balance on this seating device so that, at least for inexperienced users, there must be the possibility that at least one of the tilting joints is blocked. This results from the fact that, upon deflection of the tilting joint at the base of the seating device into a specific direction, a deflection of the upper tilting joint in the same direction takes place in a preferred manner.

SUMMARY OF THE INVENTION

The invention is based, therefore, on the object of providing an active dynamic seat ensuring, on the one hand, a seating position active to an adequate extent and, on the other hand, permitting a harmless use of the seating device even without a prolonged training phase and/or familiarization phase.

Moreover, the invention is based on the task of creating an active dynamic seat that can be produced in a simple and economical way.

The fixed connection of the seat part of the seating device according to this invention with the intermediate piece and the connection of the intermediate piece with the base, which can be deflected into any direction, ensure, on the one hand, an active dynamic sitting. On the other hand, the use of a single tilting joint in conjunction with a device for restoring the intermediate piece and the seat part into the neutral position ensures that the seating device can be utilized even by practically untrained persons without a long period of familiarization since the equilibrium of the seating device according to this invention is not labile to the great extent as in case of previously known active dynamic seats.

By the use of a special tilting joint which permits, besides tilting of the intermediate piece or the seat part, simultaneously the vertical shifting of the intermediate piece relatively to the base, it is possible to perform restoring into the neutral position and the vertical resilient action of the seating device of this invention by means of a single mechanism.

According to a preferred embodiment of the invention, the tilting joint is fashioned as a ball bearing or a dual-gimbal bearing 30.

According to a further embodiment of the invention, the restoring device is designed as an elastic diaphragm connected, on the one hand, below the bearing point with the intermediate piece and, on the other hand, with the base. Moreover, this diaphragm can exhibit recesses for setting a desired elasticity characteristic.

According to another embodiment of the invention, the restoring devices can be pretensioned, a stop being included at the same time for the vertical upward movement of the intermediate piece.

Additional embodiments of the invention can be derived from the dependent claims.

BRIEF DESCRIPTION OF THE DRAWINGS

The invention will be described in greater detail below with reference to embodiments illustrated in the drawings wherein.

DETAILED DESCRIPTION OF THE EMBODIMENTS

Figure 1:
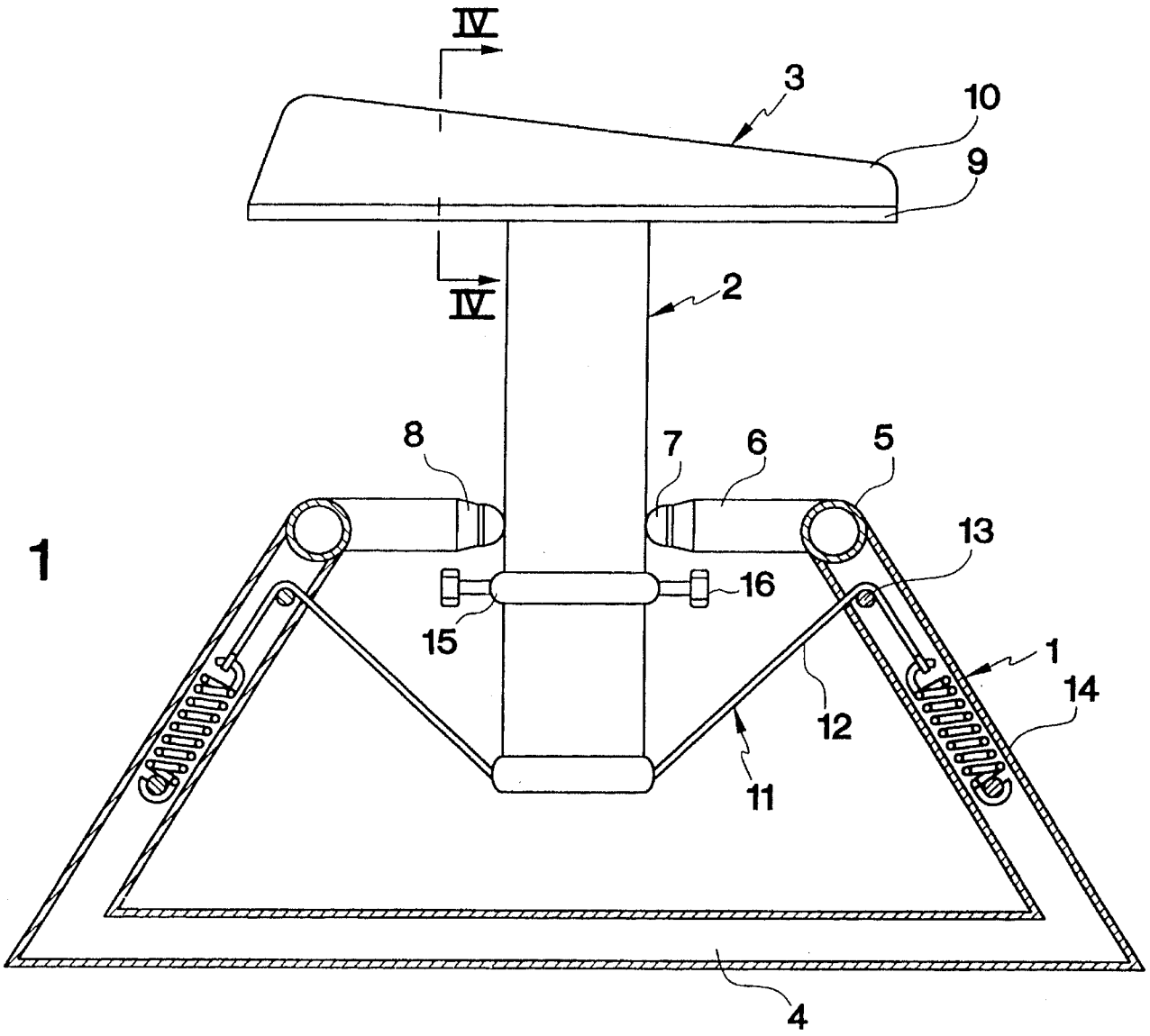
FIG. 1 shows a first embodiment of the seat according to this invention.

The embodiment of the seating device of this invention illustrated in FIG. 1 consists of a base 1, an intermediate piece 2, as well as a seat part 3.

The base 1 essentially comprises a base part 4 in the shape of a hollow conical section. The base part 4 has a double wall and thus is designed to be hollow on the inside. The upper ends of the inner and outer walls of the hollow cone section are integrally connected to a frame part 5. Several arms 6 extend radially toward the inside, starting from the frame section 5.

Respectively one ball or roller 7 is retained rotatably, in a cage 8 designed correspondingly, at the inner ends of these arms 6. Rotation here must be possible at least about one axis extending in parallel to the horizontal tangent in the contact point of the ball or roller 7 with the intermediate piece 2.

In this way, the intermediate piece 2 is supported in its central, cylindrical zone to be displaceable in the vertical direction and tiltable in any lateral direction in the base 1. In order to prevent the occurrence of a clamping action or twisting or, respectively, increased frictional forces in the region of the bearing during a tilting movement, the balls or rollers 7 are supported in the corresponding cages 8 to be resilient preferably in the radial direction. The required spring deflection for the balls or rollers 7 is, however, relatively small since, in such seating devices, the maximum tilting angles are in the range from about 10° to 20°.

Figure 5:
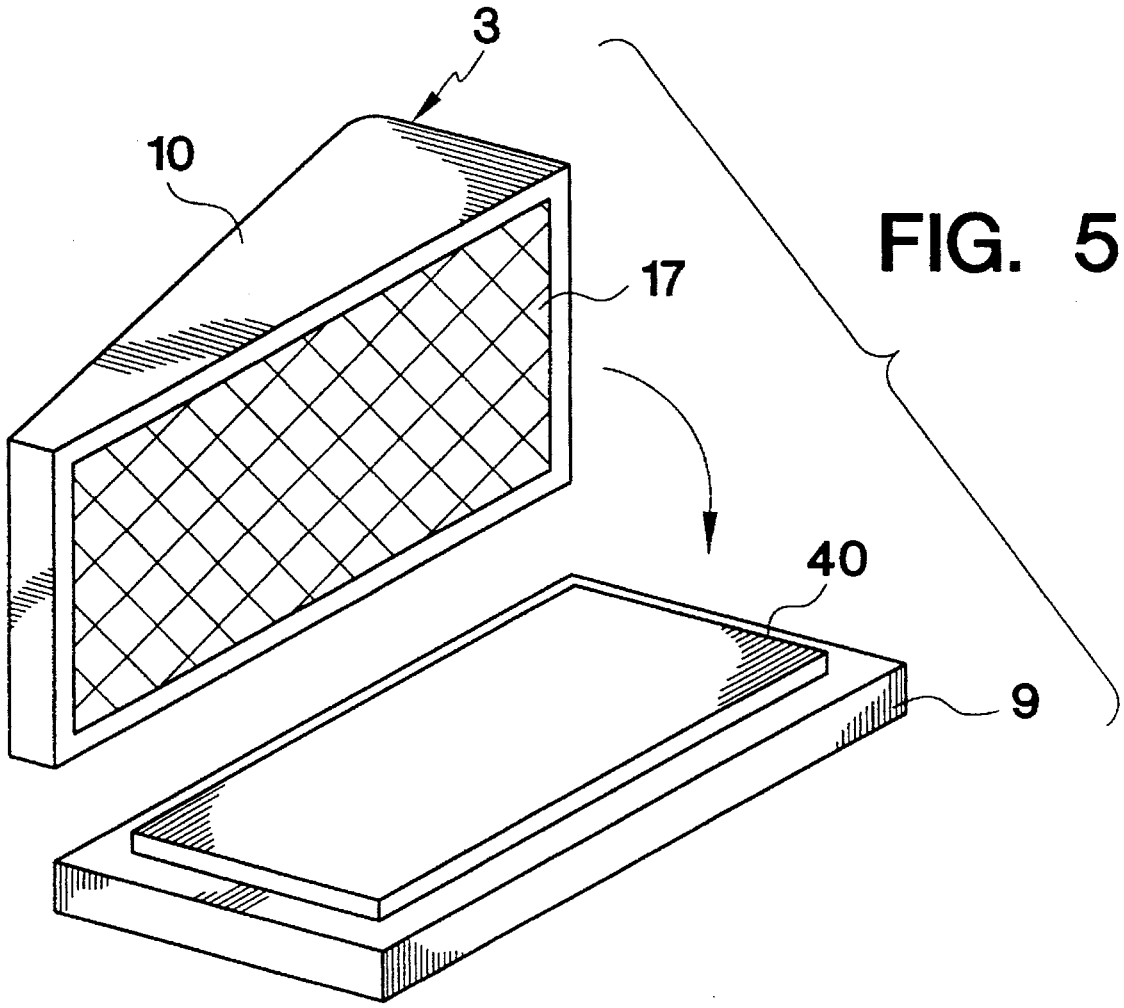
FIG. 5 shows the connection means for selectively connecting a seat cushion to a seat part.

At its upper end, the cylindrical intermediate piece 2 is firmly connected to a plate 9 of the seat part 3, this plate having a circular shape, for example. A seat cushion 10 is arranged on this plate. The seat cushion 10 can consist, for example, of fabric-covered foam material and can optionally be joined to the plate 9 fixedly or releasably as by known conventional selective connection means 40, shown by a block in FIG. 5. To promote an anatomically favorable sitting attitude, the seat cushion 10 can be designed to be convex, concave, planar, or wedge-shaped. In case of a wedge-shaped design, the higher end of the wedge should be in the back of the seated person.

Furthermore, the seat cushion can exhibit a dimensionally stable core 17 in a preferred embodiment in order to maintain the shape desired for improving the sitting attitude essentially even under load.

Several restoring devices 11 engage in the zone of the lower end of the intermediate piece 2; these devices serving for restoring the tilting movement as well as for resetting the vertical movement of the intermediate piece 2. The restoring devices 11 consist herein of flexible tensioning elements 12 attached at the periphery of the intermediate piece 2 and extended into the interior of the base part 4 through corresponding openings in the inner wall of the base part. In the interior of the base part 4, the tensioning elements 12 are rerouted by means of rerouting elements 13, fashioned as rollers, for example, so that these elements 12 extend substantially in parallel to the inner or outer wall of the base part 4. The ends of the tension elements 12 are connected to coil springs 14 each of which are likewise arranged in the interior of the base part 4. The coil springs 14 are pretensioned herein, even if the seat part 3 is not under load, with the weight force of the seat part 3 and the intermediate piece 2.

Moreover, the coil springs can be additionally prestressed to produce higher restoring forces for the tilting motion as well as for the vertical movement of the intermediate piece 2. In this case, though, the upward movement of the intermediate piece 2 must be restricted to maintain the desired pretensioning when the seat part 3 and, respectively, the intermediate piece 2 are not under load.

For this purpose, a stop ring 15 is arranged at the intermediate piece 2 below the mounting point, this ring cooperating with the balls or rollers 7, the cages 8, or the arms 6 and thus limiting the vertical movement of the intermediate piece 2 in the upward direction.

In the preferred embodiment of the invention, the stop ring 15 is made to be displaceable and lockable on the intermediate piece 2 in order to make it possible to set the pretensioning of the restoring devices 11 at a predetermined value. For fixing the position of the stop ring 15 on the intermediate piece 2, the stop ring can exhibit locking screws 16 acting directly on the intermediate piece 2, or the stop ring can be designed as a clamping ring with corresponding devices for release and clamping actions.

At the same time, the stop ring 15 prevents lifting off of the intermediate piece 2 or the seat part 3 from the rest of the seating device.

The base 1 can, of course, also assume any other desired shape ensuring the stability of the seating device and permitting the support of the intermediate piece 2 in the aforedescribed way. For example, the base can include several feet arranged in stellate fashion, these feet being drawn upward toward the intermediate piece, the bearing for the intermediate piece 2 being formed at the upper end of these feet.

Moreover, several casters can be mounted to the base 1 as is conventional in order to facilitate the shifting of the seating device.

In another embodiment, the base 1 can exhibit a bearing surface that is curved downwardly in a slightly convex fashion, likewise facilitating the displacement of the seating device on account of the smaller supporting area. Furthermore, it has been found that such a very slight curvature of the supporting surface—with a diameter of the base of about 50 cm to 60 cm, the marginal zone of the base should have a spacing of about 0.5 cm to 1 cm from a planar supporting surface—has a positive effect on the desired sitting attitude.

Figure 2:
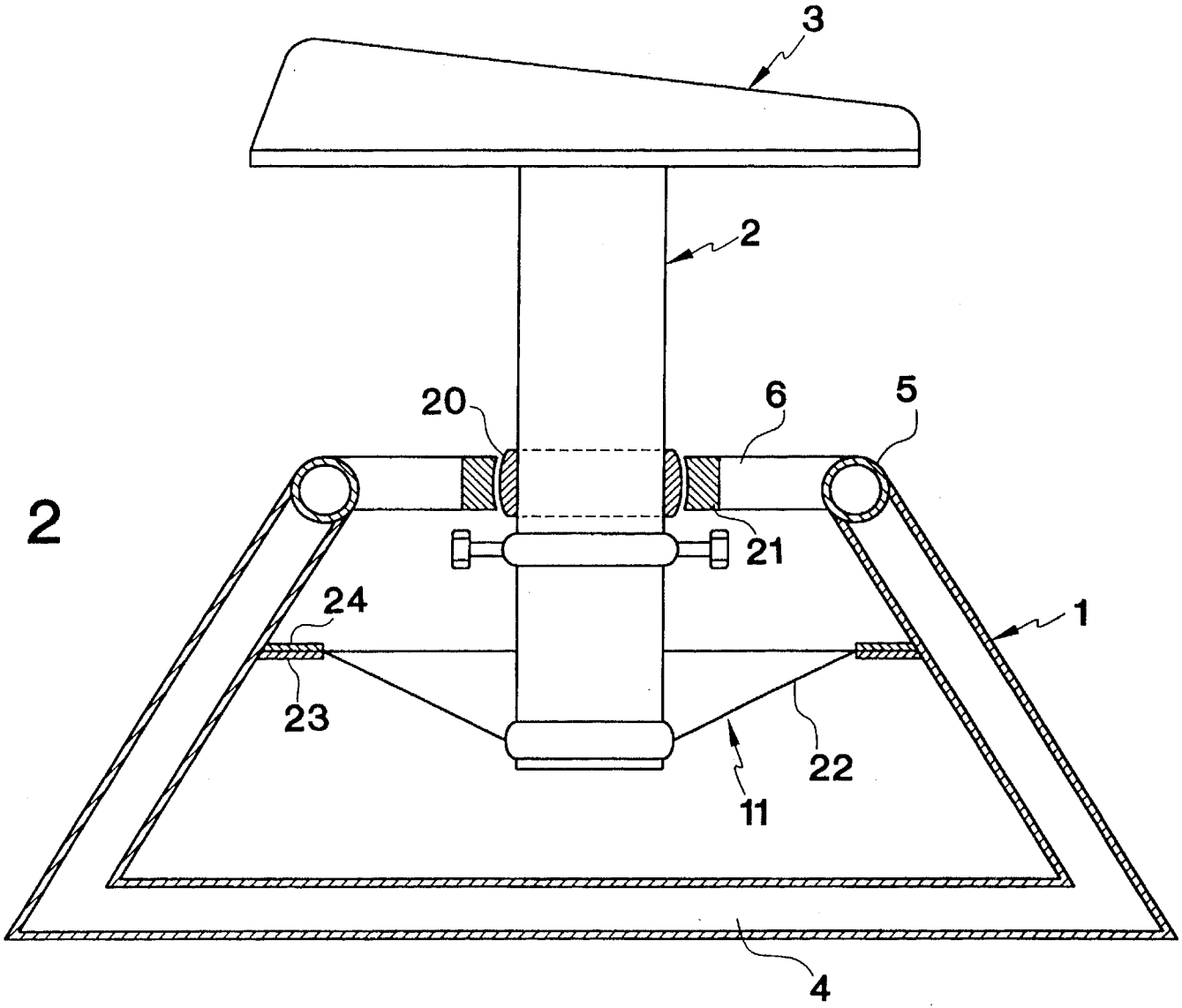
FIG. 2 shows a second embodiment of the seat according to this invention.
Figure 3:
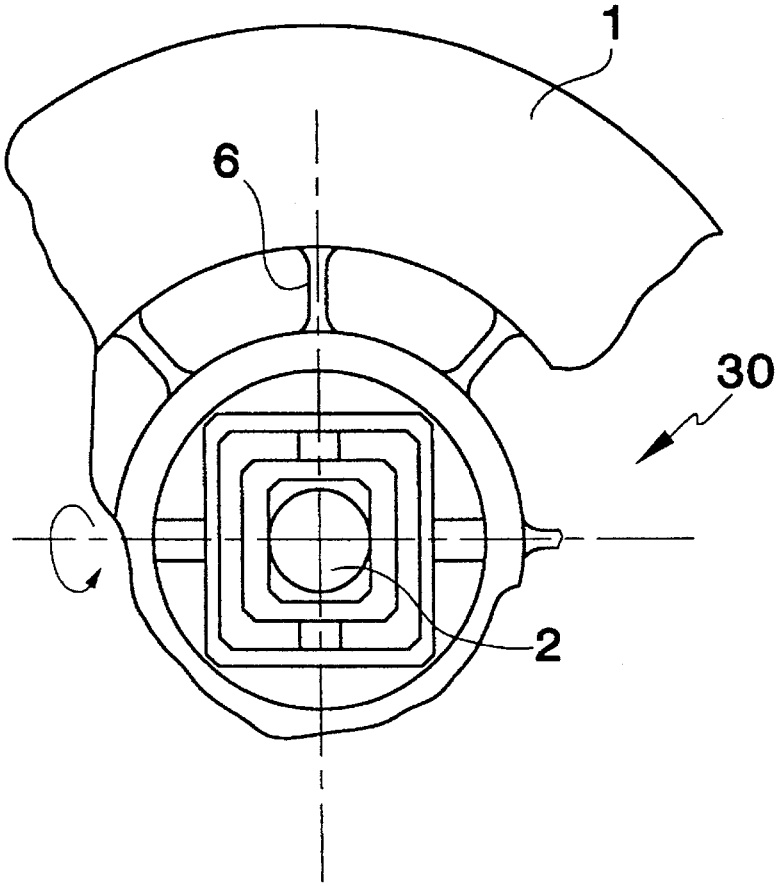
FIG. 3 shows a dual gimbal bearing from above.
Figure 4:
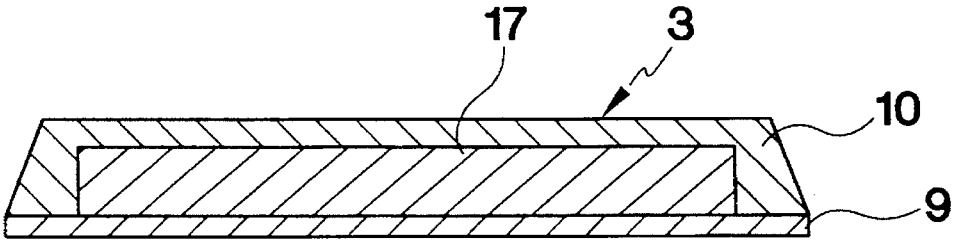
FIG. 4 shows a cross-section of a core structure of the seat cushion along a Section line IV—IV of FIG. 1.

The mode of operation of the embodiment of the invention illustrated in FIG. 2 corresponds essentially to that of the above-described embodiment. However, there are differences, on the one hand, in the structure of the bearing of the intermediate piece 2 in the base 1 and, on the other hand, in the design of the restoring devices 11.

The intermediate piece 2 is supported in the base 1 by means of a bearing part 20 having the shape of a sphere or a truncated sphere, i.e. the form of a sphere cut off at the top and bottom in horizontal planes. The diameter of the sphere is to be selected larger than the diameter of the intermediate piece 2. The sphere or truncated sphere exhibits a bore, the diameter of which corresponds essentially to the outer diameter of the intermediate piece 2, so that the bearing part 20 can be pushed onto the intermediate piece 2 and is guided on the latter substantially without play. If the bearing part 20 has the shape of a truncated sphere then the bore is to be arranged preferably centrally with the axis of rotation of the bearing part.

The bearing part 20 cooperates with a bearing part 21 held in a horizontal plane by the arms 6. To facilitate mounting of the bearing, the bearing ring 21 can be fashioned to be bipartite and can be releasably connected to the arms 6.

Consequently, also the bearing designed in this fashion permits, on the one hand, the tilting movement of the intermediate piece 2 and, on the other hand, the vertical displacement of the intermediate piece 2 relatively to the base 1.

The intermediate piece 2 can, of course, also be supported in the base 1 by means of any other bearing permitting the tilting movement as well as a vertical shifting of the intermediate piece 2, such as, for example, a part supported in the base in dual-gimbal fashion, this part accommodating the intermediate piece 2 in a bore to be vertically displaceable.

The restoring device 11, in the embodiment of the invention shown in FIG. 2, consists of a substantially circular elastic diaphragm 22 which, on the one hand, is connected in the zone of its center with the lower region of the intermediate piece 2 and, on the other hand, is held by means of suitably designed retaining means in the interior of the base part 4.

The retaining device, as shown in FIG. 2, can consist, for example, of a ring 23 connected integrally with the inner sidewall of the base part 4 in the horizontal position at a predetermined level above the bottom of the base part 4. The diameter of the unextended elastic diaphragm 22 is selected herein preferably so that this diameter is slightly larger than the inner diameter of the ring 23. In this case, the external marginal zone of the diaphragm 22 can be fastened in a simple way by means of an additional clamping ring 24, this external marginal zone resting, in the unextended condition, on the ring 23 if the mounting point of the diaphragm 22 with the intermediate piece 2 is located substantially in the plane of the ring 23. The clamping mounting of the diaphragm 22 between the rings 23 and 24 can be brought about, for example, by means of several clamping screws distributed over the circumference of the rings.

The elastic diaphragm 22 can consist, for example, of rubber or silicone and can be equipped with one recess or several recesses to obtain the desired elasticity characteristic.

In the extreme case, the "diaphragm" can also consist of elastic bands, the ends of which are connected to the inner wall of the base part 4 in the above-described way.

The dimensioning of the restoring devices must be such that, on the one hand, a safe restoring of the unstressed seat part or intermediate piece into the neutral position takes place and, on the other hand, the desired characteristic of the labile equilibrium and therefore the desired characteristic of the active dynamic seat position is attained.

Moreover, the characteristic of the restoring devices should either be adapted so that, with the usual loads, the tilting movement is limited to a specific maximum angle, or a limiting device is to be provided specifically for this purpose. This limiting device can consist, for example, of a circular stop on the bottom of the base part 4, this stop being arranged centrally to the vertical axis of the unstressed intermediate piece 2 and restricting the deflection of the lower region of the intermediate piece to a predetermined value.

I claim:

1. An active dynamic seat comprising:

a base including a base part and a tilting joint assembly;

a rigid intermediate piece, the intermediate piece including an upper end portion, a central portion, and a lower end portion;

at least one restoring device interconnecting the base and the lower end portion of the intermediate piece; and a seat part connected to the upper end of the intermediate piece, wherein the seat part is rigidly connected to the upper end portion of the intermediate piece, the central portion of the intermediate piece is connected to the base via the tilting joint assembly such that the intermediate piece is tiltably moveable in a horizontal direction and is displaceable in a vertical direction, and the at least one restoring device restores the tilting movement and simultaneously restores the vertical movement of the intermediate piece and of the seat part.

2. The seat according to claim 1 further comprising a bearing piece mounted about the central portion of the intermediate part to be longitudinally displaceable thereal-ong, wherein the bearing part is supported in the tilting joint assembly by a bearing ring thereof.

3. The seat according to claim 1, wherein the central portion is cylindrical-shaped and the tilting joint assembly is disposed in a horizontal plane of the base, the tilting joint assembly including a ball bearing rotatable along a circular line in the horizontal plane.

4. The seat according to claim 1, wherein the tilting joint assembly includes a dual-gimbal bearing.

5. The seat according to claim 1, wherein the at least one restoring device is disposed at least in part within the base part.

6. The seat according to claim 1, wherein the at least one restoring device includes coil springs.

7. The seat according to claim 1, wherein the at least one restoring device is pretensioned in a direction radial to the intermediate piece.

8. The seat according to claim 1, wherein the central portion is cylindrical-shaped and the tilting joint assembly is disposed in a horizontal plane of the base, the tilting joint assembly including a roller bearing rotatable along a circular line in the horizontal plane.

9. The seat according to claim 1, wherein the at least one restoring device includes elastic bands.

10. The seat according to claim 1, wherein the base part is shaped as a hollow conical section.

11. The seat according to claim 1, further comprising a stop ring disposed about the central portion of the intermediate piece.

12. The seat according to claim 1 further comprising a seat cushion, the seat cushion being releasably connected to the seat part, the seat cushion having a shape selected from the group consisting of planar, convex, concave, or wedge.

13. The seat according to claim 12 wherein the seat cushion has a core structure, said core structure being substantially dimensionally stable even under stress.

14. The seat according to claim 1 further comprising a stop provided on the intermediate piece, wherein the at least one restoring device is pretensioned in a radial direction and a vertical direction to the intermediate piece.

15. The seat according to claim 14, wherein the stop is longitudinally displaceable along the intermediate piece.

16. The seat according to claim 1 further comprising a seat cushion, the seat cushion being fixedly connected to the seat part, the seat cushion having a shape selected from the group consisting of planar, convex, concave, or wedge.

17. The seat according to claim 16 wherein the seat cushion has a core structure, said core structure being substantially dimensionally stable even under stress.

* * * * *